United States Patent [19]

Röhrig

[11] 4,202,402

[45] May 13, 1980

[54] TRANSFER DEVICE FOR BILLETS AND BLOOMS OF A MULTISTRAND CONTINUOUS CASTING INSTALLATION FOR METALS

[75] Inventor: Adalbert Röhrig, Wädenswil, Switzerland

[73] Assignee: Concast AG, Zürich, Switzerland

[21] Appl. No.: 834,578

[22] Filed: Sep. 19, 1977

[30] Foreign Application Priority Data

Oct. 7, 1976 [CH] Switzerland ..... 12688/76

[51] Int. Cl.[2] ..... B22D 11/08

[52] U.S. Cl. ..... 164/263; 83/157; 198/489; 414/107

[58] Field of Search ..... 164/425, 426, 446, 263, 164/269; 83/110, 157, 80, 159; 214/1 P; 198/489, 614; 414/107

[56] References Cited

U.S. PATENT DOCUMENTS

| | | | |
|---|---|---|---|
| 3,464,481 | 9/1969 | Hartzell | 164/263 X |
| 3,472,309 | 10/1969 | Calderon | 164/263 X |
| 3,495,651 | 2/1970 | Kokop et al. | 164/263 X |
| 3,601,263 | 8/1971 | Stratton | 214/1 P |
| 3,698,469 | 10/1972 | Greenberger et al. | 164/426 X |
| 3,773,103 | 11/1973 | Burkhardt | 164/426 X |
| 3,817,316 | 6/1974 | Kock | 164/426 |
| 3,908,746 | 9/1975 | Follrath | 164/263 X |

*Primary Examiner*—J. M. Meister

*Attorney, Agent, or Firm*—Werner W. Kleeman

[57] ABSTRACT

A transfer device for billets or blooms of a multistrand continuous casting installation for metals, especially steel, with associated cutting stations, devices for removing the dummy bar out of the outfeed lines as well as for the storage thereof and a transverse transport device for the cut lengths of the hot strand. The devices for removal of the dummy bars out of the outfeed lines, the storage devices of which are arranged approximately parallel to the outfeed lines and the transverse transport device are dispositioned partially within the cutting paths of the hot strands.

The method for operating such transfer device contemplates that after the cut lengths of the hot strands have reached their predetermined lowered position they are initially brought into a preparatory or waiting position between the related outfeed line and the transverse transport device.

2 Claims, 2 Drawing Figures

Fig.1
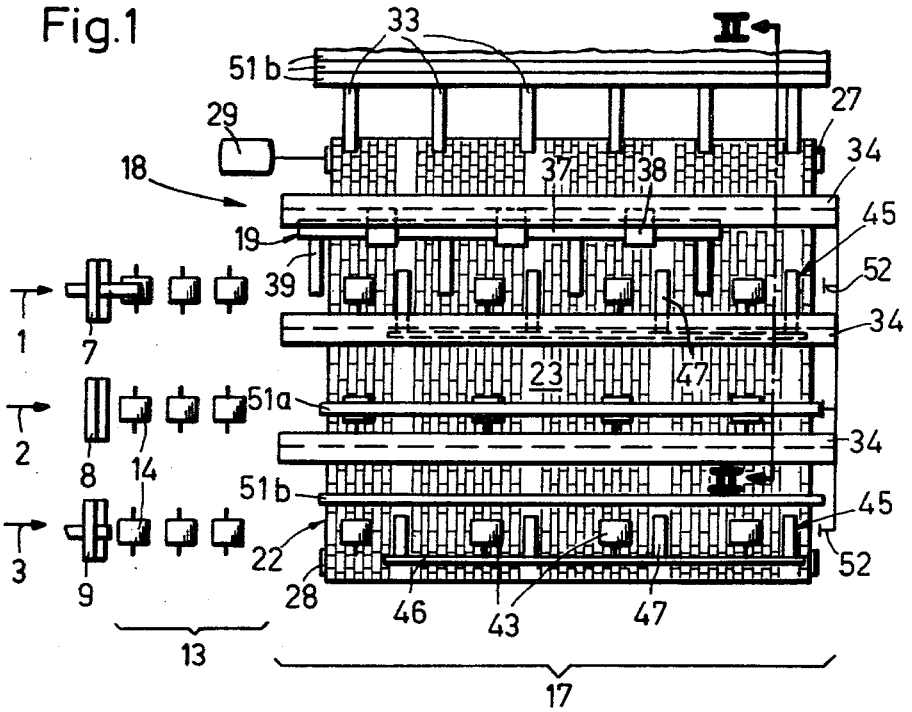
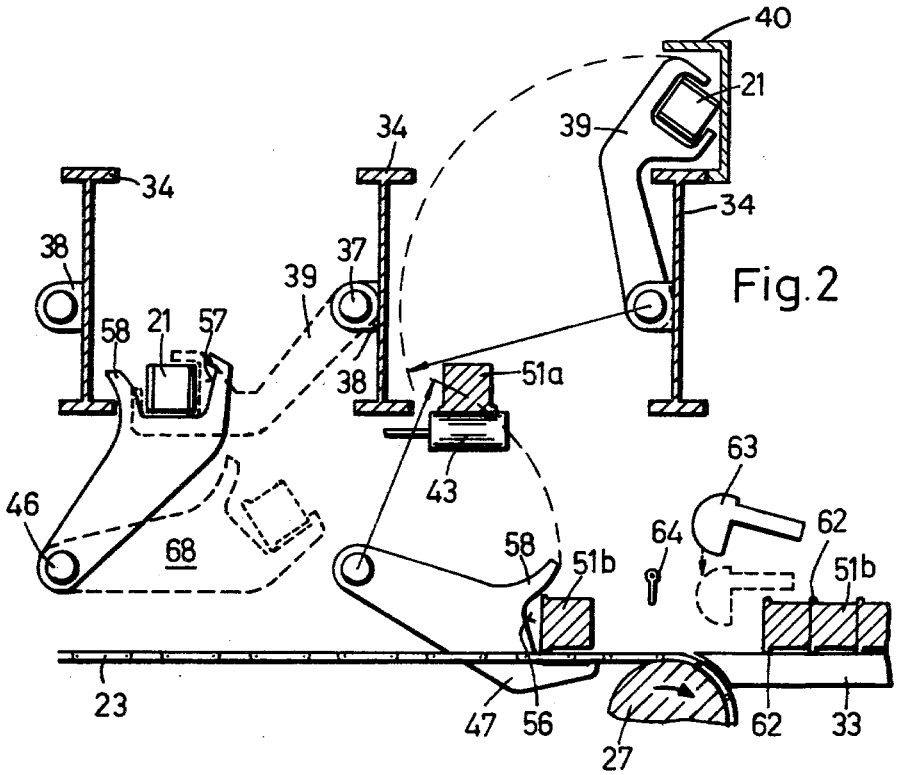
Fig.2

TRANSFER DEVICE FOR BILLETS AND BLOOMS OF A MULTISTRAND CONTINUOUS CASTING INSTALLATION FOR METALS

BACKGROUND OF THE INVENTION

The present invention relates to a new and improved construction of transfer or outfeed device for continuously cast strands, especially billets or blooms of a multistrand continuous casting installation for metals, particularly steel, with associated cutting stations, devices for removing the dummy bars out of the outfeed or transfer lines as well as for the storage thereof and a transverse transport device for the cut lengths of hot strands, and additionally, the invention pertains to a method of operating such transfer device.

With multistrand continuous casting installations where the strand is guided horizontally or along paths inclined slightly upwardly with regard to the horizontal, there can be employed articulated dummy bars.

There are known to the art continuous casting installations wherein each dummy bar is separated from the hot cast strand at the cutting station. The dummy bars are thereafter brought out of the transfer or outfeed lines for the cut lengths of the hot strand, and such removed dummy bars then must be stored, following the cutting paths, above or adjacent or below the outfeed line, to enable transport of such hot strand. This storage of the dummy bars after the cutting paths or stations is, however, associated with the drawback that there is required an increased length of the transfer or outfeed device and thus an enlarged size of the casting hall.

In order to be able to shorten such increased length of the transfer device it is known to arrange a transverse transport device for a four strand-continuous casting installation or machine at the height of the transfer lines. This transverse transport device is arranged after the cutting paths. The dummy bars are mounted at inclined paths located above such transverse transport device. The existence of coordination problems for the outfeed of the cut-to-length hot strands requires that there be provided a buffer path between the cutting stations and the transverse transport device and equally subdivision thereof to both sides of the transfer or outfeed lines. This increases the equipment costs of the continuous casting installation and its operating costs.

SUMMARY OF THE INVENTION

Hence, with the foregoing in mind it is a primary object of the present invention to avoid the aforementioned drawbacks and to shorten and simplify the transfer device.

Still another significant object of the present invention aims at the provision of a new and improved construction of transfer device for continuously cast strands, in particular billets and blooms, of a multistrand continuous casting installation for metals, especially steel, and a novel method of operating the same, wherein the aforementioned drawbacks can be effectively overcome or at least appreciably minimized.

Still a further significant object of the present invention aims at the provision of a new and improved construction of transfer device for continuously cast strands of a multistrand continuous casting installation for steel and a method of operating the same, which transfer device is relatively simple in construction and design, economical to manufacture, extremely reliable to use, not readily subject to malfunction or breakdown, and enables shortening of the transfer device as well as unnecessary overdimensioning of the casting hall or area where the casting machine or installation is erected.

Now in order to implement these and still further objects of the invention, which will become more readily apparent as the description proceeds, the transfer or outfeed device of the present invention is manifested by the features that the devices for the removal of the dummy bars out of the transfer or outfeed lines, and the storage devices of which are arranged approximately parallel to the transfer or outfeed lines, has such storage devices as well as the transverse transport device arranged partially within the cutting paths of the hot strand.

With the shortening of the transfer or outfeed device it is also possible to shorten the hall, resulting in considerable cost savings.

A transverse transport device arranged at the height of the outfeed or transfer lines previously required a buffer path or acceleration path, in order to be able to collect and simultaneously transversely drag the strand sections of the individual strand which were cut-off at different times. Such paths increase the length of the transfer or outfeed device. In order to reduce the size of such paths to a minimum length, it is a feature of the present invention to arrange the transverse transport device below the transfer or outfeed lines.

The arrangement of a transverse transport device for all strands leads, however, to difficulties as concerns the storage of the dummy bars. It is not possible in all instances to remove the dummy bars out of the relevant transfer or outfeed lines, without blocking the passage of at least a number of hot strand sections which are to be transversely dragged. Additionally, since the dummy bars seldom arrive at the same time there are present coordination problems. In order to avoid these drawbacks, it is a further recommendation of the present invention that the devices for the removal and storage of the dummy bars comprise upwardly rockable levers.

In order to be able to lower the hot strand sections in a controlled manner onto the transverse transport device —in contrast to throwing them down— and additionally tilting them once about their lengthwise edge, further advantageous features of the invention for the deposition of the cut lengths of hot strands onto the transverse transport device contemplate the provision of pivotal levers for each strand, the free ends of which in the starting position possess a respective approximately horizontal support surface and in the pivotal direction a respective upwardly inclined directed tilting surface for the cut-to-length hot strand. On the other hand, due to the controlled lowering of the hot strand sections there is avoided any pushing, which can lead to damage of the hot strand sections and a more massive construction. On the other hand, the rotation operation which is contemplated prevents the widened portions at the ends of the hot strand sections from coming to lie adjacent one another, these widened portions being caused due to the shearing or cutting of the hot strand. Should the widened sections come to lie next to one another, this can disadvantageously result in a bending-through of such sections upon the cooling bed, leading to disturbances which hamper the further processing of the strand section.

The mode of operation of a transfer device which has been shortened by following the teachings of the invention must be, however, capable of accommodating the exact time courses of individual operations within each strand. A coordination of such time courses, especially in the presence of a larger number of strands, is associated with difficulties. In order to obtain a greater amount of time, a further facet of the invention contemplates that the cut-to-length hot strands, after reaching its predetermined lowered position, is initially brought into a waiting or preparatory position between the related transfer or outfeed line and the transverse transport device.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a top plan view of a transfer or outfeed device for a three strand-billet casting installation and constructed according to the teachings of the present invention; and FIG. 2 is a vertical sectional view, taken substantially along the line II—II of FIG. 1.

DETAILED DESCRIPTION OF THE PREFERRED EMBODIMENTS

Describing now the drawings, in FIG. 1 there is illustrated a multistrand continuous casting installation, here shown by way of example as a three-strand continuous casting installation or casting machine for steel billets, generally indicated by the three arrows marked by reference characters 1, 2 and 3. Shears or cutter means 7, 8 and 9 in each instance form the related cutting station. In the direction of travel of the strands there is arranged directly following the shears or cutting means 7, 8, 9 an acceleration path 13, the drive rolls or rollers 14 of which accelerate the hot strands 51*a* which are cut-to-length by the shears or cutting means. Downstream of the cutting stations defined by the shears 7, 8 and 9 and neighbouring the acceleration path 13 is a section 17 of a transfer or outfeed device 18. Within this section 17 there are arranged both a device 19, provided for each strand 1, 2 and 3, however to simplify the showing of the drawing only illustrated for the strand 1, each of which device 19 serves to remove an articulated dummy bar 21 out of the transfer or outfeed line which extends in the direction of travel of the strand 1, and further, there is also arranged a transverse transport device 22 which is common for all of the strands 1, 2 and 3, this transverse transport device 22 serving for the transport of the cut-to-length hot strand 51*a*.

Control of the device 19 for the removal of the dummy bar 21 and control of the means for distinguishing between the dummy bar 21 and the strand 1 may be accomplished by any conventional apparatus, such as limit switches, devices for measuring heat radiation, semiautomatic devices controlled by operators, etc. This transverse transport device 22 is located below the strands 1, 2, 3 and conventionally consists of an endless transport chain 23 and the sprocket wheels 27 and 28, wherein the sprocket wheels 27 are driven by any suitable electric motor 29. The transverse transport device 22 feeds the billets to a cooling bed or a collecting grate, the support of which has been generally indicated by reference character 33.

Located above the transverse transport device 22 are the stationary I-beams or supports 34, at which there is secured in each case the device 19 for the removal of the dummy bar 21. A shaft 37 of this device 19 is mounted by means of the bearings 38 at the web of the I-beam or support 34 and possesses pivotable arms 39 which extend in a claw-like fashion into the strand path of travel and the transfer or outfeed line, respectively. In FIG. 2 there is shown in broken lines the position of the pivotable arms 39 during the reception of a dummy bar 21. At a predetermined position of the dummy bar 21 upon driven rollers or rolls 43 of the section 17, which rolls 43 are mounted at one end, there is triggered a control command governing the detection of the dummy bar 21. Consequently, the pivotable arms 39 pivot or rock the dummy bar 21, which for instance might be housed in a magazine or cassette 40, schematically illustrated in FIG. 2, upwardly out of the transfer line into the storage position above the I-beam 34. The dummy bar, in this position, is located at a place which is less exposed to the thermal radiation of the billet.

The described devices 19 for the removal of the dummy bars 21 out of the transfer or outfeed lines as well as their storage approximately parallel to such transfer lines and the transverse transport device 22 are arranged at the section 17 and partially within the cutting paths of the strand. Each cutting path is composed of the entrainment path of the cutting station with the hot strand and the length of the longest strand section which is to be cut. This cutting path is somewhat smaller than both the acceleration path 13 and the path of the section 17, which in turn means that the transverse transport device 22 for the most part is located within the cutting path, and the size of this part is dependent upon the casting speed and the billet length.

Within the section 17 there is additionally provided for each strand 1, 2 and 3 a lowering device 45 for the controlled deposit of the billets upon the transport chain 23. To simplify the showing of the drawing such lowering device 45 has not been illustrated for the strand 2. Each such lowering device 45 comprises a shaft 46 together with its pivotable or pivotal levers 47, such shaft being mounted below the I-beam 34.

Now when a billet 51*a*, traveling over the rollers 43, strikes against a stationary stop or impact member 52 at the end of the section 17, then there is imparted to the lowering device 45 a command, in order to downwardly rock by means of the pivotal levers 47 the billet 51*a* onto the transport chain 23 or equivalent structure. Each pivotal lever 47 is provided at its free end with a support surface 56 which is approximately horizontally disposed in the starting position, a tilting surface 57 which is inclined upwardly in the direction of pivoting, and a thumb member or projection 58. Immediately at the start of the pivotal motion the thumb member or projection 58 pushes the billet 51*a* or the like from the rollers 43 onto the support surface 56. During the further pivotal movement the billet 51*a*, under the influence of the force of gravity, tilts onto the tilting or tilt surface 57. In the end position the tilting surface 57 and the support or deposition plane of the transport chain 23 are approximately flush with one another. Due to the tilting of the billet there is achieved a deposit of the billet which is free of any pushing action or surges and which billet is turned through an angle of about 90° about its own lengthwise axis. The turned position of the billet has been designated by reference character 51*b*. In addition thereto, there is achieved the result that the widened portion 62 of the billet, which widened portions are formed due to the shearing action, are vertically aligned upon the cooling bed and do not come into contact with one another. There is thus avoided a bending of the billets 51*b* which are held in spaced relationship from one another by the widened portions 62 by means of a pusher or slide 63 which conveys the same upon the collecting grate 33. Moreover, there is prevented any pushing of the billets onto one another.

Only after a billet 51*b* has been deposited upon the chain 23 is the latter placed into motion and the billet 51*b* is moved out of the pivotal levers 47. Thereafter, the pivotal levers 47 are again brought back into their starting position. The transport chain 23, to the extent that the time plan permits, in each case always transports only one billet 51*b*, so that these billets do not mutually hinder one another by colliding with one another upon the transverse transport device 22. After the billet 51*b* has actuated a switch 64 then the pusher or slide 63 is activated and pushes the billet 51*b* onto the conventional and therefore merely schematically illustrated cooling bed containing the supports 33. At the same time the chain 23 stops, whereafter another billet 51*a* can be lowered onto the chain 23.

Another mode of operation is contemplated by a broken line illustrated waiting or preparatory position 68 of the pivotal or pivotable lever 47 between the transfer line and the end or terminal position of the pivotal lever, so that, on the one hand, a trailing billet 51*a* can move without hinderance up to the stop or impact member 52 and, on the other hand, another billet 51*b* can move upon the chain 23 below the pivotal levers 47. The billets therefore, immediately after reaching their predetermined lowered position within the section 17, can initially be brought into this preparatory or waiting position between the related transfer or outfeed line and the transverse transport device 22. The operational mode utilizing the waiting or preparatory positions also enables simultaneously depositing a number of billets upon the chain 23.

In order to rock-back the lever 47 the thumb member or projection 58 is rotatably and spring-loaded arranged at the lever 47, so that the thumb member or projection 58 can pass below the next billet 51*a*. A stop or impact member for the thumb or projection 58 and arranged at the lever 47 enables the already mentioned pushing of the billet 51*a* onto the support surface 56.

The described transfer device can be employed most beneficially in conjunction with strand sections exceeding a length of 8 meters, because the linearity of the strand section poses difficult problems when working with such length.

While there are shown and described present preferred embodiments of the invention, it is to be distinctly understood that the invention is not limited thereto, but may be otherwise variously embodied and practiced within the scope of the follwoing claims.

Accordingly, what I claim is:

1. A transfer or outfeed device for castings, in particular billets or blooms of a multistrand continuous casting installation for metals, especially steel, comprising:
   - means, defining cutting stations arranged within cutting paths for the continuously cast strands, for cutting-to-length such cast strands;
   - means for removing dummy bars out of transfer lines of the cast strands;
   - storage means for storing the dummy bars;
   - transverse transport means, being arranged below the transfer lines, for transporting the cut-to-length hot cast strands;
   - said means for removing the dummy bars out of the transfer lines being arranged within the cutting paths of the hot strands and having said storage means arranged approximately parallel to said transfer lines;
   - said storage means and said transverse transport means being partially arranged within the cutting paths of the hot strands;
   - pivotal lever means, provided for each strand, for depositing each cut-to-length hot strand upon the transverse transport means;
   - said pivotal lever means each having a free end and, in a starting position of each said pivotal lever means, said free end thereof possesses a respective approximately horizontal support surface and, in a pivotal position thereof, a respective tilting surface for each cut-to-length hot strand, said tilting surface being directed upwardly at an inclination.

2. The transfer device as defined in claim 1, wherein:
   - said means for removing and storing the dummy bars comprise upwardly rockable lever means.

* * * * *